United States Patent [19]

Granzow et al.

[11] Patent Number: 4,529,119

[45] **Date of Patent: * Jul. 16, 1985**

[54] TAMPERING-PROOF CASSETTE USED IN A CASH DISPENSER

[75] Inventors: Robert H. Granzow, Miamisburg; Dale L. Placke, Dayton, both of Ohio

[73] Assignee: NCR Corporation, Dayton, Ohio

[ * ] Notice: The portion of the term of this patent subsequent to Jul. 16, 2002 has been disclaimed.

[21] Appl. No.: 522,449

[22] Filed: Aug. 12, 1983

[51] Int. Cl.[3] ..... E05G 1/00

[52] U.S. Cl. ..... 232/43.3; 109/43; 109/50; 70/439

[58] Field of Search ..... 109/31, 38, 39, 43, 109/50, 44; 70/432, 433, 435, 436, 437, 439, 440; 232/43.1, 43.3, 43.5; 312/215, 216, 218, 221

[56] References Cited

U.S. PATENT DOCUMENTS

| | | | |
|---|---|---|---|
| 506,647 | 10/1893 | Littell | 70/436 |
| 3,276,835 | 10/1966 | Hall | 312/333 |
| 3,854,655 | 12/1974 | Armstrong | 232/4 R |
| 4,131,001 | 12/1978 | Gotto | 70/14 |
| 4,253,016 | 2/1981 | Hirose | 235/381 |
| 4,275,667 | 6/1981 | Hilton | 109/44 |
| 4,337,393 | 6/1982 | Hilton | 235/487 |

FOREIGN PATENT DOCUMENTS

| | | | |
|---|---|---|---|
| 6642 | 7/1979 | European Pat. Off. . | |
| 0010598 | 5/1980 | European Pat. Off. . | |
| 22694 | 1/1981 | European Pat. Off. . | |
| 549160 | 2/1923 | France . | |
| 593280 | 5/1959 | Italy | 70/436 |
| 103173 | 3/1923 | Switzerland . | |
| 998148 | 7/1965 | United Kingdom . | |
| 2039264A | 6/1980 | United Kingdom . | |
| 2079832 | 1/1982 | United Kingdom | 70/416 |

OTHER PUBLICATIONS

U.S. Appl. Ser. No. 509,488, filed 6/30/83, by Grant G. H. Keir et al.

Examiner's Report from U.K. Appln. No. 8202932; Filed Feb. 3, 1983, by Grant G. H. Keir et al.

*Primary Examiner*—Gene Mancene

*Assistant Examiner*—John G. Weiss

*Attorney, Agent, or Firm*—Albert L. Sessler, Jr.; Elmer Wargo

[57] ABSTRACT

A tampering-proof container for storing currency for use in conjunction with an automated teller machine (ATM). The currency door of the container through which the currency passes when the container is mounted on an ATM is moved positively between the open and closed positions when on the ATM. An indicator wheel within the container gives an indication or count of the number of times the currency door has been opened and closed to provide a check on potential sophisticated pilfering. When the count on the indicator wheel reaches a programmed predetermined amount, the currency door is locked in a closed position with first and second locking linkage inside the container locking the currency door in the closed position. A seal on a loading door on the container must be broken to gain access to the inside of the container to unlock the first and second locking linkage and to reset the indicator wheel.

11 Claims, 6 Drawing Figures

TAMPERING-PROOF CASSETTE USED IN A CASH DISPENSER

CROSS-REFERENCES TO RELATED APPLICATIONS

This application is related to copending application Ser. No. 522,448 which was filed on the same date as was this application and which was also assigned to the same assignee.

BACKGROUND OF THE INVENTION

This invention relates to a portable and tampering-proof container or cassette for storing currency notes therein, with the cassette being used in association with an automated teller machine (ATM) or a cash dispensing machine, for example.

Stated briefly, to utilize an ATM, a customer inserts an identifying card into the machine to identify his account number, and then he enters certain data on the keyboard of the ATM to further identify himself and to indicate the amount of cash in the form of currency, for example, that he wishes to obtain from the ATM in a typical cash dispensing function. The ATM will then process the transaction, update the user's account to reflect the current cash withdrawal, dispense the requested currency, and return the identifying card to the customer as part of a routine operation.

The currency to be dispensed from an ATM is generally stored in a container or cassette which is inserted into the ATM and which positions the currency or bills to be withdrawn from the container by "picking" apparatus associated with the ATM as part of a routine cash dispensing described previously. Some of these cassettes are lockable and others are non-lockable.

These cassettes are loaded with currency or bills, generally at a central bank, and then the cassettes may be turned over to a security firm for delivery in armored vehicles, for example, to a location or branch bank at which an ATM is located. Personnel at the branch bank, for example, then insert the loaded cassette into the ATM.

In order to minimize the theft of currency from the cassettes which are exposed to the various people in the delivery and handling sequence mentioned in the previous paragraph, cassettes which are referred to as "secure" cassettes have been developed. These "secure" cassettes have, generally, complex mechanisms or electrical systems which prevent an unauthorized access into the cassette by the various people mentioned, for example, in the delivery and handling sequence mentioned.

In one prior-art cassette, for example, the associated shutter door (through which the bills pass when the cassette is positioned in operative relationship with an associated ATM) is locked or latched in a closed position after loading it with bills, and during transit in the handling sequence mentioned. As the cassette is positioned in operative relationship with the ATM, the shutter door is opened to permit the ATM to "pick" bills therefrom in a routine cash dispensing operation as described. When the number of bills remaining in the cassette reaches a predetermined low amount in normal operations, the ATM prevents further cash dispensing operations and gives an indication that another fully-loaded cassette is required. An authorized person then removes the partially-loaded cassette from the ATM prior to loading a fully-loaded one therein.

As the partially-loaded cassette is removed from the ATM, the shutter door closes and is latched in the closed position before the cassette is completely removed from the ATM. The cassette is designed so that the shutter door may be opened once (when put into an ATM, for example), and when it is taken out of the ATM, it is latched in the closed position so that it must be returned to the central bank for opening, refilling if necessary, and thereafter setting the associated latch so that it can be subjected to only one cycle of opening and closing as described. The partially-loaded, closed, and latched cassette is then forwarded to the central bank (in the example described) where the cassette is opened, filled with currency, and latched in the closed position.

When a cassette is inserted in an ATM, it is sometimes necessary to remove the cassette in order to clear out certain jams which may occur in the picker mechanism associated with the ATM, for example. When the prior-art cassette mentioned is removed from the ATM, the associated shutter door is latched in the closed position. This means that the cassette has to be returned to the central bank (in the example described) in order to have the cassette opened and re-latched. Because each cassette containing $20 bills, for example, may have up to about 60,000 (U.S.) dollars therein, a considerable amount of money may be involved in such return activities which do not represent a profitable use of money. While these cassettes are referred to as "secure" cassettes, it is obvious that the latch mechanisms mentioned do not prevent someone from taking the cassette and breaking it open to get the currency stored therein. Perhaps these "secure" cassettes should be viewed as efforts to eliminate "sophisticated pilfering" of the currency stored therein.

SUMMARY OF THE INVENTION

This invention relates to a tampering-proof container comprising a housing having first and second openings therein; a first closure moveable between closed and open positions with regard to said first opening; a second closure moveable between closed and open positions with regard to said second opening; a seal to secure said second closure in said closed position and to permit said second closure to be moved to said open position only upon breaking said seal to thereby give an indication that said second closure has been opened; means for storing items within said housing; means for moving said first closure from said closed position to said open position to enable said items to be removed therethrough and for moving said first closure from said open position to said closed position; means for indicating a zero position and a number of times that said first closure has been moved from said closed position to said open position after said seal is applied to said second closure; locking means cooperating with said indicating means for locking said first closure in said closed position when said first closure has been moved to said open position and returned to said closed position a predetermined number of times; and second locking means movable between locking and unlocking positions within said housing and also which said second locking means is moved into said locking position with regard to said first locking means when said first locking means locks said first closure in said closed position, said second locking means being moveable to said unlocking position only after said seal is broken and said closure is moved to said open position to enable said first locking means to be unlocked.

The cassette made according to this invention provides a low-cost, simple, tampering-proof cassette which obviates the problems mentioned with some of the prior-art cassettes for storing currency.

These advantages and others will be more readily appreciated after reading the following description and drawing; accordingly, a list of the advantages will be found at the conclusion of the detailed description of the invention.

DETAILED DESCRIPTION OF THE INVENTION

Figure 1:
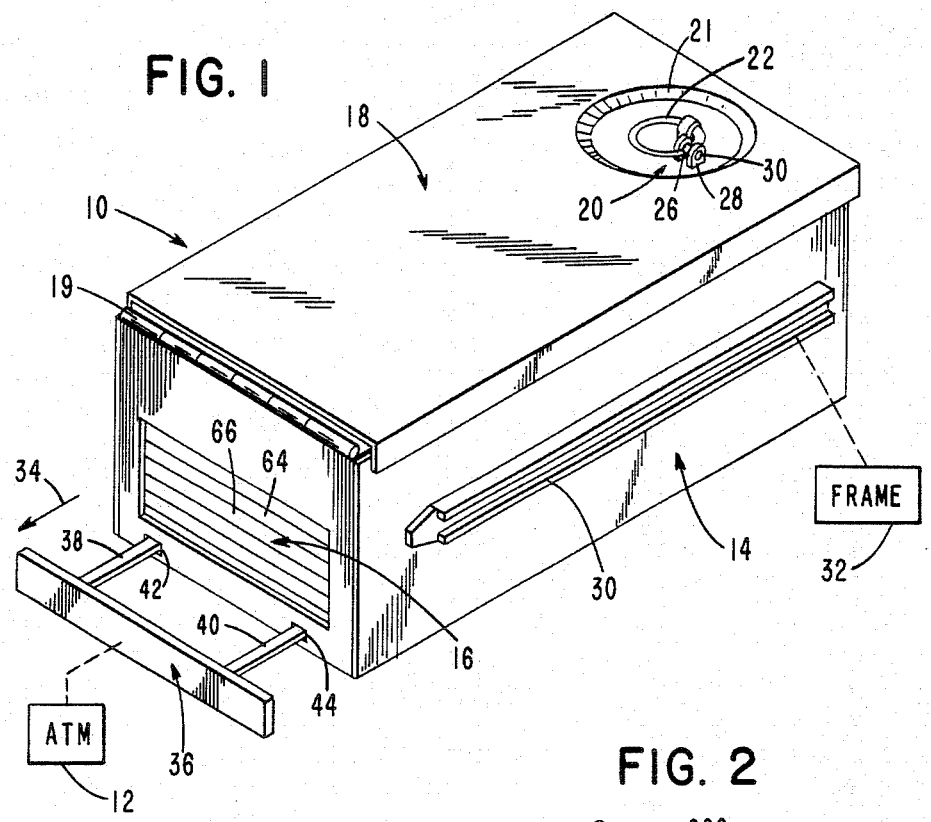
FIG. 1 is a general view, in perspective of a preferred embodiment of the cassette of this invention as it is being inserted into an ATM.
Figure 2:
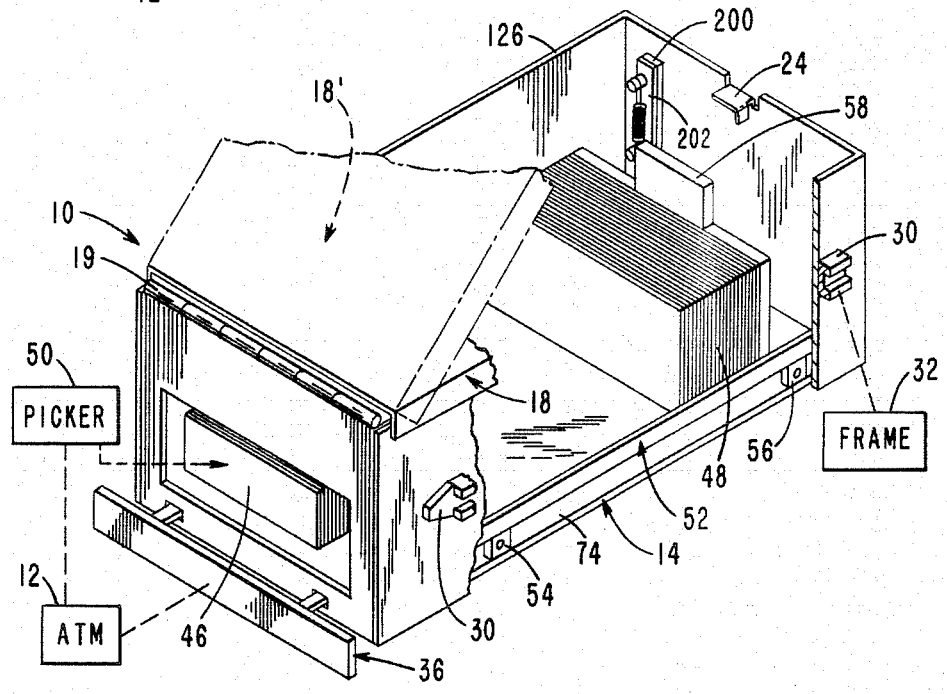
FIG. 2 is a general view similar to FIG. 1, showing the cassette in operative relationship with the ATM and also showing a bill support structure which supports the currency or bills on edge and resiliently urges the bills towards a picker mechanism associated with the ATM.

FIG. 1 is a general perspective view of the tampering-proof cassette of this invention which is designated generally as 10 and which is shown in a position in which it is to be inserted into operative relationship with an automated teller machine hereinafter referred to as ATM 12. The ATM 12 is conventional such as the NCR 5080, for example, which is available from the NCR Corporation of Dayton, Ohio. The cassette 10 is comprised of a housing 14 having a first closure such as shutter door 16 which is moveable between the closed position shown in FIG. 1 and the open position shown in FIG. 2. The cassette 10 also includes a second closure or lid 18 which is connected to the housing 14 by a hinge 19 and is moveable between the closed position shown in FIG. 1 and the open position shown in dashed outline 18' in FIG. 2. However, it should be pointed out that when the cassette 10 is in operative relationship with the ATM 12, the lid 18 is closed as shown in FIG. 1; FIG. 2 is essentially a diagrammatic showing to facilitate a description of the cassette 10.

The cassette 10 (FIG. 1) also includes a seal 20 which is mounted in a well 21 on the lid 18 to provide a tampering-indicating way of locking the lid 18 in the closed position. Locating the seal 20 in the well 21 presents a flush appearance of the cassette 10 to the ATM 12. The seal 20 includes a steel ring 22 (having a welded joint) which is used to rotate a finger lever (not shown) located under the lid to coact with a flange 24 (FIG. 2) to lock the lid 18 in the position shown in FIG. 1. For example, after the cassette 10 is loaded with currency and prepared for use in an ATM as will be described hereinafter, the ring 22 is pivoted to a vertical plane (as viewed in FIG. 1) and rotated in a clockwise direction to lock the lid 18 in the closed position. Thereafter, ring 22 is moved to the horizontal or flat position shown in FIG. 1 in which a portion of the ring lies between two spaced upright extensions 26 and 28 which are secured to the lid 18. A plastic "wire" (not shown) is then inserted through the openings 30 in the extensions 26 and 28 and "sealed" as is conventionally done with some of the newer plastic seals (not shown) which also have a tab with an identification number thereon to identify a particular seal used on a particular cassette 10 which is sent to a particular ATM 12. The lid 18 cannot be opened unless the seal 20 is broken to permit the "O" ring 22 to be raised to the vertically oriented operating plane mentioned. Breaking the seal 20 is an indication that the lid 18 of the cassette 10 has been opened.

The cassette 10 (FIG. 1) also has side rails, like side rail 30, on opposed sides of the housing 14 to enable the cassette to be aligned and mounted in the frame 32 of the ATM 12. When the cassette 10 is mounted on the frame 32 and pushed in the direction of arrow 34, the cassette 10 engages a stationary actuating mechanism 36 which includes the push rods 38 and 40 (shown only functionally in FIG. 1), which fit into holes 42 and 44, respectively, in the housing 14 of the cassette 10. As the cassette 10 is pushed on the push rods 38 and 40, the shutter door 16 is moved to the open position shown in FIG. 2.

When the cassette 10 is in operative engagement with the ATM 12, as shown in FIG. 2, the shutter door 16 is opened and the first note or bill 46 of the stack 48 of bills is exposed to the picker mechanism 50 which is shown only diagrammatically. The cassette 10 may have to be modified slightly to adapt to different picker mechanisms associated with the ATM 12; however, this aspect may be conventional and does not form a part of this invention.

The cassette 10 is loaded with a stack 48 of bills like 46 which are supported on a conventional bill support structure 52 which is detachably secured to the housing 14 by flanges 54 and 56, for example, which are secured to anchor areas (not shown) inside the cassette 10 so as to enable the support structure 52 to be removed only when the lid 18 is in the open position (shown as 18') in FIG. 2. The support structure 52 includes a back-up plate 58 which is biased by a spring (not shown) to urge the stack 48 of bills towards the picker mechanism 50. The stack 48 of bills is restrained at the open end of the cassette 10 (by conventional means, not shown) so as to enable the picker mechanism 50 to pick successively the first bill 46 in the stack 48 to perform the cash dispensing function mentioned earlier herein. After a bill like 46 is picked, it is transferred by transport mechanisms (not shown) to a receptacle, for example, where additional bills are collected in response to the monetary amount requested, prior to letting the bills become accessible to the customer as a result of a routine cash dispensing transaction.

When the shutter door 16 is moved from the closed position shown in FIG. 1 to the open position shown in FIG. 2, it opens from the top to the bottom as viewed in FIGS. 1 and 2. The shutter door 16 is conventional and is comprised of a plurality of horizontally positioned slats like 64 and 66 (FIG. 1) which are joined at their long sides to provide a flexible secure closure or door which can be moved under the bill support structure 52 as shown in FIG. 2 when the shutter door 16 is opened.

The ends of the slats like 64 and 66 are retained in "U"-shaped channels 236 and 238 (FIG. 3) located within the housing 14 to enable the cassette 10 to be tampering-proof and to provide a guide for moving the shutter door 16 therein. A conventional plastic multifilament tape (not shown) is secured to the slats like 66 and 66 on the inside of the shutter door 16 to give a visual indication when an attempt is made to remove any of these slats during a theft or vandalistic activity.

Figure 3:
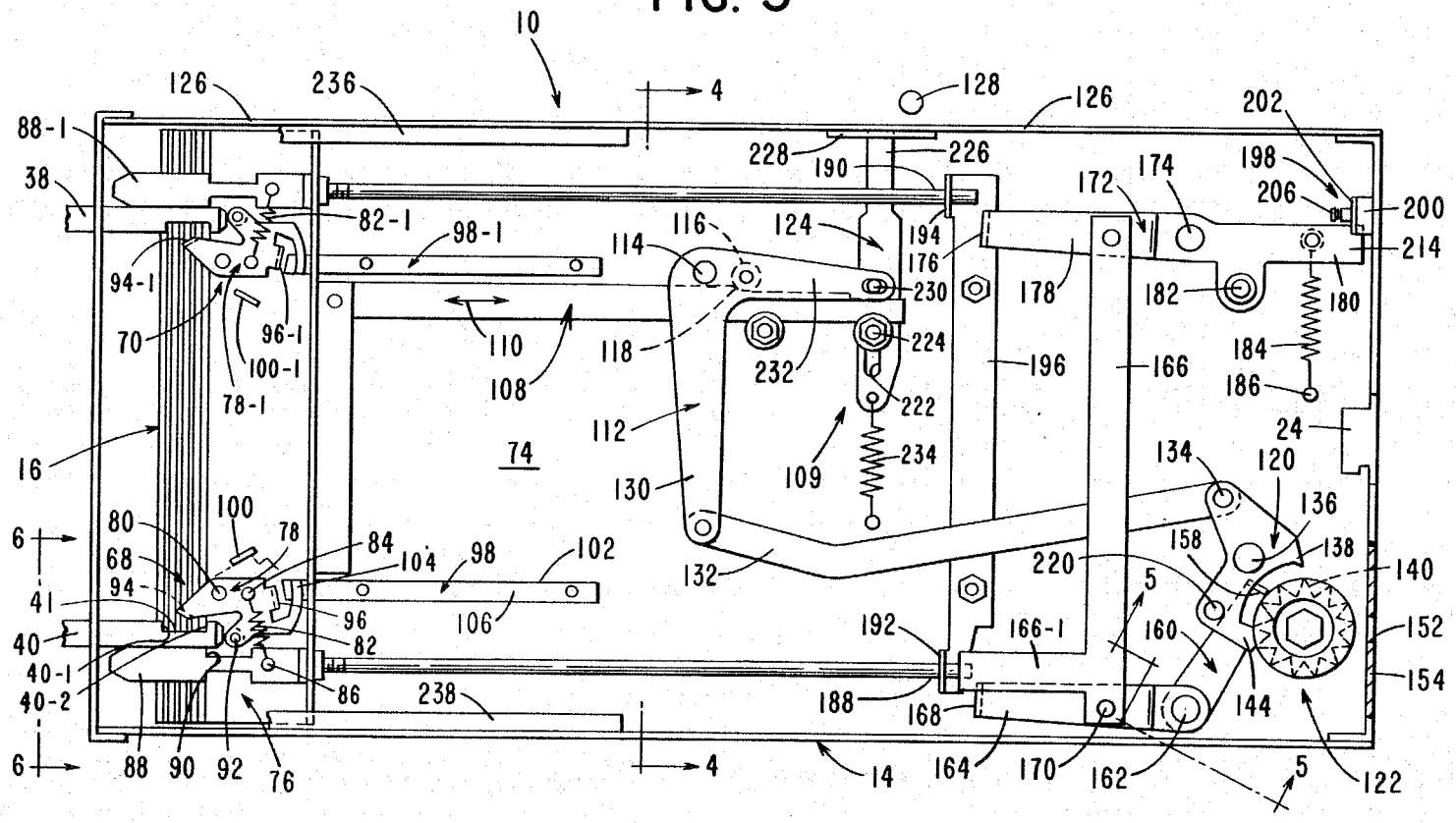
FIG. 3 is a plan view of the cassette with the bill support structure removed therefrom to show the tampering proof mechanism associated with the cassette.

FIG. 3 is a plan view of the cassette 10 shown in FIGS. 1 and 2, with the bill support structure 52 being removed therefrom to facilitate a showing of the means for making the cassette 10 secure and the means for moving the shutter door 16 between the closed and open positions mentioned.

Figure 6:
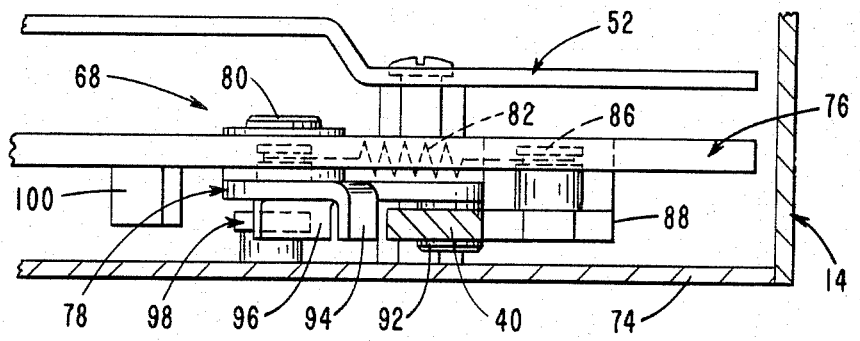
FIG. 6 is an elevational view taken along the line 6—6 of FIG. 3 to show additional details of the means for moving the shutter door between the closed and open positions shown in FIGS. 1 and 2, respectively.

The means for moving the shutter door 16 includes the actuating mechanisms 68 and 70 shown in FIG. 3, with mechanism 68 being shown in more detail in FIG. 6. Because the mechanisms 68 and 70 are identical but mirror images of each other, a description of only mechanism 68 will be given.

The actuating mechanism 68 coacts with the associated push rod 40 to positively drive the shutter door 16 between the closed and open positions mentioned. The shutter door 16 extends towards the bottom 74 of the housing 14, is guided at its ends in appropriate channels 236 and 238 (only portions of which are shown in FIG. 3), and is secured to a cross member which is referred to as a truck 76. When the truck 76 is moved to the right from the position shown in FIG. 3, the shutter door 16 is opened, and when it is returned to the position shown in FIG. 3, the shutter door 16 is in the closed position.

The actuating mechanism 68 (FIG. 3) includes a pawl 78 which is pivotally mounted on the truck 76 by stud 80. While the pawl 78 is shown in solid outline in FIG. 3 to facilitate a showing thereof, it is actually located between the truck 76 and the bottom 74 of the housing. The pawl 78 is resiliently biased in a clockwise direction as viewed in FIG. 3 by a tension spring 82 having one end secured to a stud 84 on the pawl 78 and the remaining end thereof secured to a stud 86 on a control rod 88 which is fixed to the truck 76 to move therewith. The control rod 88 has a recess 90 therein to provide clearance for a stud 92 which is fixed to the pawl 78. The stud 92 (FIG. 6) extends towards the bottom 74 of the housing 14 and is aligned to engage the push rod 40 when the cassette 10 is mounted in the ATM 12. The pawl 78 also has a down-turned abutment surface or tang 94 thereon which is moved between the first and second abutment surfaces 40-1 and 40-2 located in a recess 41 in the push rod 40. The pawl 78 also has a down-turned abutment surface or tang 96 thereon which, in the position shown in FIG. 3, is aligned to abut against the end of a bar 98 which is secured to the bottom 74 of the housing 14.

Assuming that the cassette 10 is to be inserted in the ATM 12 in a routine manner, as it is pushed onto the actuating mechanism 36, the associated push rods 38 and 40 engage their associated actuating mechanisms 70 and 68, respectively. The operation of the actuating mechanism 70 is the same as that of actuating mechanism 68; therefore, a discussion of the interaction between push rod 40 and the actuating mechanism 68 only will be discussed.

As the cassette 10 is pushed on the push rod 40 (FIG. 3), its leading edge engages the stud 92 on the pawl 78 causing the pawl 78 to rotate in a counterclockwise direction (as viewed in FIG. 3) against the bias of spring 82. As this rotation of pawl 78 begins, the associated tang 96 moves out of blocking position with the bar 98, and the tang 94 moves into the recess 41 on the push rod 40 between the first and second abutment surfaces 40-1 and 40-2 of the push rod 40. As the cassette 10 is pushed further onto the push rod 40, the pawl 78 is rotated further in a counterclockwise direction until it abuts against a stop 100 (on the truck 76) to provide the driving force to move the truck 76 and the shutter door 16 attached thereto to the right as viewed in FIG. 3. Note that as the push rod 40 is moved to the right (relatively) from the position shown in FIG. 3, it pushes the stud 92 out of the recess 90. Also, after the pawl 78 is rotated against the stop 100, the tang 96 rides on the inside edge 102 of the stationary bar 98; this keeps the pawl 78 from rotating prematurely in a clockwise direction which would release the tang 94 from the push rod 40. The cassette 10 is then pushed all the way on the push rods 40 and 38 to open the shutter door 16 completely and to place the cassette into operative relationship with the ATM 12.

When the cassette 10 is to be removed from the ATM 12, the cassette 10 is pulled off the push rod 40 (and push rod 38), and as it is pulled off, the tang 94 engages the second abutment surface 40-2 to move the truck 76 towards the left to the home position shown in FIG. 3, in which position the shutter door 16 is in the closed position. Note that the tang 94 stays in engagement with the second abutment surface 40-2 (because of the tang 96 riding on the side 102 of bar 98) to positively return the shutter door 16 to the home position. After the shutter door 16 is closed and the cassette 10 is near to being pulled off the push rods 38 and 40, the tang 96 of the pawl 78 will clear the bar 98 permitting the pawl 78 to rotate in a clockwise direction (as viewed in FIG. 3) permitting the tang 94 to move out of the recess 41 in push rod 40, permitting the cassette 10 to be pulled free of the push rods 40 and 38. The pawl 78 has an arcuately-shaped leg 104 which rides on the top surface 106 of the bar 98 to provide stability to the pawl 78.

The actuating mechanism 70 (FIG. 3) operates in the same manner as does actuating mechanism 68, and the mechanism 70 includes the same parts as does mechanism 68 except for the mirror-like aspect mentioned earlier herein. Accordingly, the parts in mechanism 70 are given the same reference numbers as corresponding parts in mechanism 68 except for the addition of a (−1) which follows the part. In other words, actuating mechanism 70 has a pawl 78-1, tang 94-1, tang 96-1, control rod 88-1, spring 82-1, and bar 98-1.

Having described the actuating mechanisms 68 and 70 in FIG. 3 for moving the shutter door 16 between the closed and open positions mentioned, it appears appropriate to discuss some of the means 109 (FIG. 3) for making the cassette 10 tampering-proof. The means 109 includes the cross bar or truck 76 which has a camming lever 108 fixed thereto to move therewith in the direction of double arrow 110 and also includes the bell crank lever 112 which is pivotally mounted on a pin 114 which is upstanding from and fixed to the bottom 74 of the housing 14. A stud 116 is fixed to the underside of bell crank lever 112 to coact with a cam surface 118 on the camming lever 108. When the camming lever 108 moves to the right, as viewed in FIG. 3, as the shutter door 16 is being opened, the cam surface 118 and stud 116 coact to rotate or pivot the bell crank lever 112 in a counterclockwise direction.

The counterclockwise pivoting of crank lever 112 (as viewed in FIG. 3) performs two general functions. First, it actuates a pawl 120 associated with an indicator wheel 122, and secondly it moves a slide member 124 out of the side wall 126 of the housing 14 to coact with an abutment member 128 associated with the frame of the ATM 12 to prevent the cassette 10 from being withdrawn from the ATM until the shutter door 16 is closed.

Starting with the function of the crank lever 112 associated with the indicator wheel 122, one end 130 of the lever 112 is pivotally joined to one end of a link 132 whose remaining end is pivotally joined to the pawl 120 by a pin 134. The pawl 120 is pivotally mounted on a stud 136 which is secured to and is upstanding from the bottom 74 of the housing 14. When the crank lever 112 is rotated in a counterclockwise direction as viewed in FIG. 3, the pawl 120 rotates in a clockwise direction, causing the tooth 138 on the pawl 120 to engage one of the teeth like 140 on a ratchet wheel 142 which is part of the indicator wheel 122 as seen better in FIG. 5. As the tooth 138 on the pawl 120 moves towards a tooth like 140, the centering tooth 144 on the pawl 120 moves out of engagement with the ratchet wheel 142 (FIG. 5) permitting the pawl 120 to index the ratchet wheel 142 one tooth or one position in a counterclockwise direction as viewed in FIG. 3. For the moment, it is sufficient to state that when the cassette 10 is removed from the ATM 12, the crank lever 112 will be rotated, slightly, in a clockwise direction and the pawl 120 will be rotated in a counterclockwise direction to move the centering tooth 144 into engagement with the ratchet wheel 142 while the tooth 138 on the ratchet 120 is moved out of engagement with the ratchet wheel 142 on the indicator wheel 122.

Figure 5:
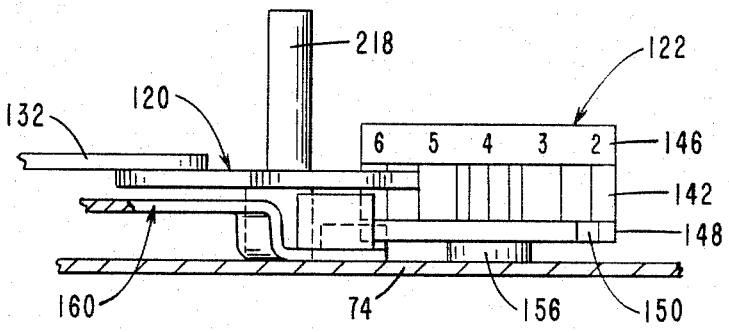
FIG. 5. is an enlarged, elevational view, taken along the line 5—5 of FIG. 3 to show additional details of the indicator wheel shown in FIG. 3.

The indicator wheel 122 also has a top wheel 146 and a lower wheel 148 as shown best in FIG. 5. The lower wheel 148 has two recesses like 150 therein which are spaced 180 degrees apart. The numbers on the top wheel 146 are visible through a window 152 (FIG. 3) located in back wall 154 of the housing 14. The indicator wheel 122 gives an indication of the number of cycles in which the shutter door 16 has been opened and closed. The ratchet wheel 142, the top wheel 146, and the lower wheel 150 (FIG. 5) are indexed as a unit and are rotatably supported on a short axle 156 (FIG. 5) which is secured to and is upstanding from the bottom 74 of the housing 14.

The cassette 10 is designed to permit the number of cycles of opening and closing the shutter door 16 to be set from one to six, for example. Assume that the indicator wheel 120 is set (as will be explained hereinafter) to permit six such cycles. As the pawl 120 indexes the indicator wheel 122 for six indexes (with the number "6" showing in window 152) a tang 158 on one arm of a second bell crank lever 160 will drop into the nearest one of the two 180 degree-spaced recesses 150, permitting the crank lever 160 to rotate slightly in a clockwise direction as viewed in FIG. 3 (after the cassette 10 is removed from the ATM 12 as will be described hereinafter). Except for dropping into the recesses 150, the tang 158 rides on the periphery of the lower wheel 148. When the crank lever 160 rotates slightly, (in the clockwise direction mentioned) on its pivoting stud 162, its other arm 164 moves a link 166 (to which it is pivotally connected by a pin 170) upwardly as viewed in FIG. 3. The link 166 has an extension 166-1 which permits the end 188 of control rod 88 to slide under the link 166 without abutting thereagainst when the end 188 moves to the right. The arm 164 also has a blocking tang 168 on its end. A third crank lever 172, which is pivoted on a stud 174 (upstanding from and secured to the bottom 74 of the housing 14) is also pivotally secured to the link 166 to receive the upward motion mentioned from the crank lever 160. The crank lever 172 also has a blocking tang 176 on its arm 178 and its other arm 180 has an actuating post or handle 182 upstanding therefrom as seen best in FIG. 4. A spring 184 (secured to the arm 180 and a stud 186 upstanding from the bottom 74 of the housing 14) is used to bias the crank lever 172 in a clockwise direction as viewed in FIG. 3, and because crank levers 172 and 160 are joined by link 166, the crank lever 160 is biased by spring 184 to rotate in a clockwise direction to enable its associated tang 158 to ride on the periphery of the lower wheel 150 (FIG. 5) and to drop into one of the two recesses 150 when one is presented to the tang 158. When the tang 158 drops into one of the recesses 150, it means that the predetermined number of cycles of opening and closing the shutter door 16 has been reached and further opening of the shutter door 16 is to be blocked. This blocking is effected when the crank lever 160 rotates clockwise due to tang 158 dropping in a recess 150. Because crank lever 172 is linked to crank lever 160, it too will rotate clockwise slightly with crank lever 160, and the tangs 168 and 176 on crank levers 160 and 172 will line up, respectively, in blocking relationship with the ends 188 and 190 of control rods 88 and 88-1, respectively (after the shutter door is closed). This means that the shutter door 16 cannot be opened until the seal 20 (FIG. 1) on the lid 18 of the cassette 10 is broken, the lid 18 raised, and the indicator wheel 122 reset by a technique to be later described herein. The ends 188 and 190 of the control rods 88 and 88-1, respectively, are slidably supported in apertured, upturned flanges 192 and 194, respectively, of an elongated plate 196 which is secured to the bottom 74 of the housing 14.

Figure 4:
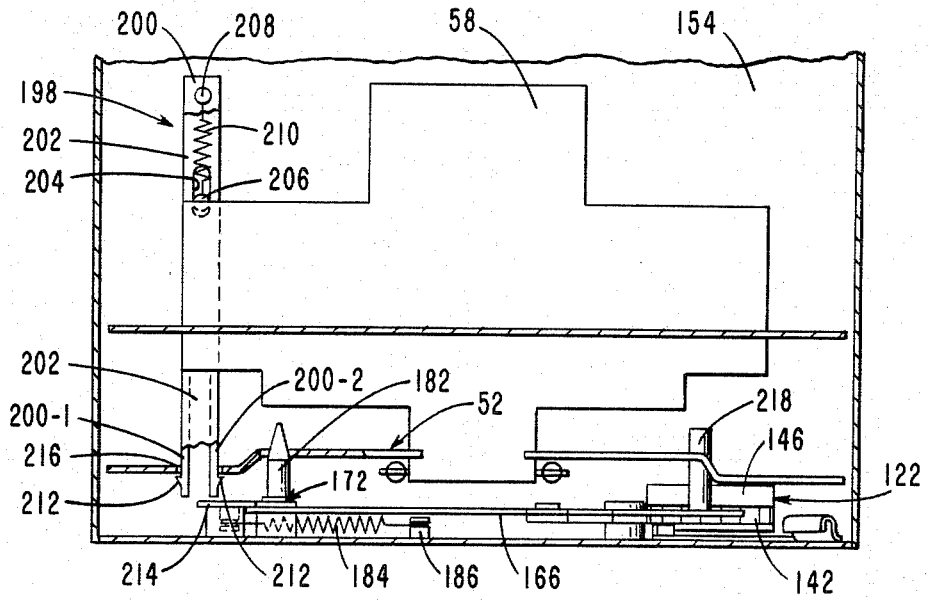
FIG. 4 is a cross sectional view, in elevation, taken along line 4—4 of FIG. 3 to show additional details of the cassette.

The means 109 for making the cassette 10 tamperingproof also includes a locking lever 198 shown in FIGS. 3 and 4. The locking lever 198 includes an elongated plastic member 200 and a metal bar 202 having the same overall length and width dimensions. Both the plastic member 200 and the metal bar 202 have aligned elongated slots like 204 (FIG. 4) therein to enable the locking lever 198 to be reciprocated in a vertical direction (as viewed in FIG. 4) with respect to a stationary stud 206 which is secured to the end wall 154. A stud 208, passing through both the plastic bar 200 and the metal bar 202, has one end of a spring 210 attached thereto with the remaining end thereof secured to the stationary stud 206 to resiliently bias the locking lever 198 in a downward direction as viewed in FIG. 4. The plastic member 200 has spaced legs 200-1 and 200-2 on its lower end as viewed in FIG. 4, with each of these ends having an abutment shoulder like 212 thereon.

When the number of cycles of opening and closing the cassette 10 has not been reached via the indicator wheel 122, the locking lever 198 is in the position shown in FIGS. 3 and 4. In this position, the locking lever 198 rests on a corner of the end 214 of crank lever 172 as a result of the downward biasing of spring 210. The lower end of locking lever 198 passes through a slot 216 (FIG. 4) in the bill support structure 52. When the predetermined number of cycles of opening and closing the shutter door 16 has been reached, the tang 158 (FIG. 3) drops into the slot 150 on the lower wheel of the indicator wheel 122 (after the shutter door 16 is closed), causing crank levers 160 and 172 to rotate in a clockwise direction (as viewed in FIG. 3) as previously explained. The clockwise rotation of crank lever 172 (as viewed in FIG. 3) causes its tang 176 to move into blocking relationship with the end 190 of control rod 88-1 and also causes the end 214 of crank lever 172 to move out from under the locking lever 198 (by moving to the right as viewed in FIG. 4), permitting the spring 210 to urge the locking lever 198 in a downward direction as viewed in FIG. 4 to thereby block crank lever 172 from rotating in a counterclockwise direction as viewed in FIG. 3; this keeps the shutter door 16 locked in the closed position.

To reset the cassette 10 after the shutter door 16 is locked in the closed position as mentioned in the previous paragraph, it is necessary to break the seal 20 on the lid 18 and open the cassette 10. In a routine operation, the cassette 10 would then be loaded with a stack 48 of bills 46, and the cassette 10 reset and sealed. To reset the cassette 10, it is necessary to squeeze together the legs 200-1 and 200-2 of the plastic bar 200 permitting the shoulders 212 (FIG. 4) to pass through the slot 216 in the bill support structure 52. After the locking lever 198 is moved sufficiently upwardly as viewed in FIG. 4, its lower end will be out of blocking engagement with the end 214 of the crank lever 172. While the locking lever 198 is held upwardly with the fingers of the right hand, for example, of a service person, the middle finger of the person's left hand is used to push the actuating handle 182 (which extends above the bill support structure 52) to rotate crank lever 172 in a counterclockwise direction, as viewed in FIG. 3, and thereby clear the tang 158 from the recess 150.

While still pushing on the actuating handle 182 with the middle finger of the left hand, the left thumb of the service person is used to push the operating handle 220 (upstanding from the pawl 120) to index the pawl 120 (by rotating it clockwise as viewed in FIG. 4) one position to enable the tang 158 to ride on the periphery of the lower wheel 148 as previously described, which positions the crank levers 160 and 172 in the non-blocking positions shown in FIG. 3. Once the crank lever 172 is in the non-blocking position shown in FIG. 3, the blocking lever 198 may be released. When released, the spring 210 urges the blocking lever 198 downwardly (as viewed in FIG. 4) causing the shoulders 212 to be cammed towards each other and to pass through the slot 216 and to enable the lower end of the metal bar 202 to rest on the top surface of end 214 of crank lever 172.

Continuing with what has been described in the previous paragraph, the top wheel 146 of the indicator wheel 122 has a green area positioned at window 152 (FIG. 3) at this time to be visible from outside the cassette. The lid 18 of the cassette 10 may then be closed and sealed as previously described, and it is ready for use in an ATM 12. Prior to inserting the cassette 10 in an ATM 12, the operator checks the window 152 and sees the green indication which means (in the embodiment described) that the shutter door 16 has not been opened since the cassette was sealed.

When the cassette 10 is placed in an ATM 12, the actuating mechanism 36 in association with the means 109 (FIG. 3) for indicating tampering will cause the indicator wheel 122 to index one position as previously described. Assume a routine operation with no problems; under this circumstance, the cassette 10, when empty or low on bills, will show a white color at the window 152. The white color indicates one cycle of opening and closing which represents a routine operation, and therefor, the cassette 10 may be routinely replenished as previously described.

In the example being described, if the cassette 10 with green color in window 152 is placed in an ATM 12, the opening of shutter door 16 will cause the white color to be displayed. If, however, a jam or malfunction occurs in the dispensing of bills 46, it may be necessary to remove the cassette 10 from the ATM 12 to fix the jam, for example. When the cassette 10 is replaced into operative engagement with the ATM 12, the actuating means 46 will initiate the change in cycles recorded on the indicator wheel 122 causing the number "2" to be displayed at window 152. If the cassette 10 and ATM 12 perform thereafter without malfunction, the ATM 12 will indicate (via its display for example) that the cassette 10 has to be refilled. When the cassette 10 is removed from the ATM, the number "2" will still be displayed at window 152. When the cassette 10 is returned to the central bank for refilling (in the example described), it must be accompanied by an explanation as to why an "extra" cycle (as evidenced by number "2") of opening and closing of the cassette 10 has occurred. In this situation, a note or explanation by the serviceperson who repaired the malfunction might be adequate. The ATM 12 itself may provide an indication of the number of times a cassette 10 has been inserted and removed from the ATM 12 to provide a correlation with the cycles recorded on the cassette 10.

In the embodiment described, the cassette 10 may be set to record up to six cycles of opening and closing of shutter door 16 as described. When the cassette 10 is set with green color showing, it means that the image viewed through the window 152 will present a white color for one such cycle, a "2" for two cycles, etc., up to a "6" for six such cycles. This series of colors and numbers is arranged and repeated between each of the slots 150 on the top wheel 146 (FIG. 5) to facilitate a setting of indicator wheel 122. If the cassette 10 is to be set (prior to sealing) to permit only two cycles of operating before locking for example, the pawl 120 is indexed until the number "4" appears at window 152. When the cassette 10 is installed on an ATM 12, the number "5" will appear at window 150 indicating the shutter door 16 has been opened. If the cassette 10 is removed from the ATM 12 to correct or fix a malfunction and thereafter it is installed in the ATM 12, the actuating means 36 will move the truck 76 and control rods 88 and 88-1 as previously described to index the pawl 120 as previously explained to show a "6" at window 152. When the control rods 88 and 88-1 are pushed to the right as viewed in FIG. 3, the end 190 of control rod 88-1 passes by the tang 176 on crank lever 172 (preventing it from rotating) to thereby prevent the tang 158 on crank lever 160 from dropping into a recess 150; this permits the actuating means 36 to open the shutter door 16. When the cassette 10 is thereafter withdrawn from the ATM 12, the end 190 of control rod 88-1 will be pulled to the left to the position shown in FIG. 3, thereby permitting the tang 158 to drop into a recess 150 as previously explained to lock the shutter door 16 in the closed position, requiring the seal 20 to be broken to unlock the locking lever 198.

The second function of the crank lever 112 (FIG. 3) alluded to earlier herein was to activate the slide member 124. The slide member 124 has an elongated slot 222 therein through which passes a stud 224 which is upstanding from and secured to the bottom 74 of the housing 14. The remaining end 226 is slidably mounted in a plate 228 secured to the side wall 126 of the housing 14. The slide member 124 has a stud 230 upstanding therefrom to coact with the slotted end 232 of the crank lever 112. A tension spring 234 is used to bias the slide member 124 downwardly, as viewed in FIG. 3, to withdraw the end 226 thereof inside the housing 14. When the crank lever 112 is rotated in a counterclockwise direction (as viewed in FIG. 3) as the cassette 10 is being installed in the ATM 12, the cassette 10 will be moved to the left of the abutment member 128 (relatively) before the crank lever 112 rotates sufficiently to push the end 226 of the slide member 124 out of the side wall 126. The cassette 10 thereafter, cannot be removed from the ATM 12 until its shutter door 16 is moved to the closed position. When the shutter door 16 is closed, the end 226 of the slide member 124 is withdrawn within the housing 14, permitting the cassette 10 to be removed from the ATM 12. The shutter door 16 is guided in conventional guides 236 and 238 which are shown only partially to illustrate the function.

The advantages of the cassette 10 in addition to those cited earlier herein are as follows:

1. Some of the prior art cassettes rely on a spring to return the shutter door 16 from the open position to the closed position. The cassette 10 utilizes the latches 68 and 70 (FIG. 3) to positively open and close the shutter door 16. Notice also that the cassette 10 cannot be removed from the actuating mechanism 36 (FIG. 1) unless the shutter door 16 is in the closed position.

2. Some of the prior-art "secure" cassettes are subject to pilfering of the currency therein by inserting wires through the first closure, like shutter door 16, to alter the count of cycles on the indicator wheel 122 (FIG. 3) after taking some currency out. Such wires and techniques cannot be used on the cassette 10 because the legs 200-1 and 200-2 of locking lever 198 (FIGS. 3, 4) must be squeezed together with one hand while manipulating other portions of the locking and pawl mechanism with the other hand as described earlier herein.

3. When the shutter door 16 is open, the tooth 138 on the pawl 120 engages the ratchet wheel 142, preventing the indicator wheel 122 from being rotated or changed to reflect a different number of "cycles".

What is claimed is:

1. A tampering-proof container comprising:

a housing having first and second openings therein;

a first closure moveable between closed and open positions with regard to said first opening;

a second closure moveable between closed and open positions with regard to said second opening;

a seal to secure said second closure in said closed position and to permit said second closure to be moved to said open position only upon breaking said seal to thereby give an indication that said second closure has been opened;

means for moving said first closure from said closed position to said open position to enable items to be removed therethrough and for moving said first closure from said open position to said closed position;

means for indicating a zero position and a number of times that said first closure has been moved from said closed position to said open position after said seal is applied to said second closure;

first locking means cooperating with said indicating means for locking said first closure in said closed position when said first closure has been moved to said open position and returned to said closed position a predetermined number of times; and second locking means movable between locking and unlocking positions within said housing and also said second locking means being moved into said locking position with regard to said first locking means when said first locking means locks said first closure in said closed position, said second locking means being moveable to said unlocking position only after said seal is broken and said second closure is moved to said open position to enable said first locking means to be unlocked.

2. The container as claimed in claim 1 in which said moving means includes means for positively driving said first closure between said closed and open positions.

3. The container as claimed in claim 1 in which said moving means includes an actuating member which is separate from said container, and also includes at least one latching device for latching said container to said actuating member to permit said container to be separated from said actuating member only when said first closure is in said closed position.

4. The container as claimed in claim 1 in which said indicating means include an indicator wheel, a ratchet wheel, and a third wheel having a periphery with at least one notch therein;

said indicator wheel, ratchet wheel and third wheel being rotatably mounted in said housing to be rotated as a unit;

said first closure having a camming lever attached thereto to be moved therewith;

a pawl member operatively connected to said ratchet wheel; and linkage connecting said camming lever with said pawl member to index said ratchet wheel one position each time said first closure is moved to said open position, said first locking means including a lever which rides on the periphery of said third wheel and coacts with said notch to lock said third wheel against rotation and thereby lock said first closure in said closed position.

5. The container as claimed in claim 4 in which said predetermined number of times is set upon said indicator wheel by moving said second locking means to said unlocking position, then moving said lever out of said notch in said third wheel and thereafter actuating said pawl member at least once to index said ratchet wheel at least one position.

6. The container as claimed in claim 5 in which said indicator wheel has indicia thereon to indicate the number of times said first closure has been moved to said open position and said housing has a window therein to enable said indicia to be visible from outside said container.

7. A tampering-proof container for storing currency bills comprising:

a housing having first and second openings therein;

a first closure moveable between closed and open positions with regard to said first opening;

a second closure moveable between closed and open positions with regard to said second opening;

a seal to secure said second closure in said closed position and to permit said second closure to be moved to said open position only upon breaking said seal to thereby give an indication that said second closure has been opened;

means for storing said currency bills within said housing;

means for moving said first closure from said closed position to said open position to enable said currency bills to be removed therethrough and for moving said first closure from said open position to said closed position;

means for indicating a zero position and a number of times that said first closure has been moved from said closed position to said open position after said seal is applied to said second closure;

first locking means cooperating with said indicating means for locking said first closure in said closed position when said first closure has been moved to said open position and returned to said closed position a predetermined number of times; and second locking means movable between locking and unlocking positions within said housing and also which said second locking means is moved into said locking position with regard to said first locking means when said first locking means locks said first closure in said closed position, said second locking means being moveable to said unlocking position only after said seal is broken and said second closure is moved to said open position to enable said first locking means to be unlocked.

8. The container as claimed in claim 7 in which said moving means includes means for positively driving said first closure between said closed and open positions.

9. The container as claimed in claim 8 in which said moving means includes an actuating member which is separate from said container, and also includes at least one latching device for latching said container to said actuating member to permit said container to be separated from said actuating member only when said first closure is in said closed position.

10. The container as claimed in claim 9 in which said indicating means include an indicator wheel, a ratchet wheel, and a third wheel having a periphery with at least one notch therein;

said indicator wheel, ratchet wheel and third wheel being rotatably mounted in said housing to be rotated as a unit;

said first closure having a camming lever attached thereto to be moved therewith;

a pawl member operatively connected to said ratchet wheel; and linkage connecting said camming lever with said pawl member to index said ratchet wheel one position each time said first closure is moved to said open position, said locking means including a lever which rides on the periphery of said third wheel and coacts with said notch to lock said third wheel against rotation and thereby lock said first closure in said closed position.

11. A tampering-proof container for storing currency bills comprising:

a housing having first and second openings therein;

a first closure moveable between closed and open positions with regard to said first opening;

a second closure moveable between closed and open positions with regard to said second opening;

a seal to secure said second closure in said closed position and to permit said second closure to be moved to said open position only upon breaking said seal to thereby give an indication that said second closure has been opened;

means for moving said first closure from said closed position to said open position to enable said currency bills to be removed therethrough and for moving said first closure from said open position to said closed position;

means for indicating a zero position and a number of times that said first closure has been moved from said closed position to said open position after said seal is applied to said second closure;

locking means cooperating with said indicating means for locking said first closure in said closed position when said first closure has been moved to said open position and returned to said closed position a predetermined number of times;

said moving means includes an actuating member which is separate from said container, and also includes at least one latching device for latching said container to said actuating member to permit said container to be separated from said actuating member only when said first closure is in said closed position.

* * * * *